United States Patent [19]

New et al.

[11] Patent Number: 4,691,658

[45] Date of Patent: Sep. 8, 1987

[54] AQUATIC SPORT DEVICE

[76] Inventors: Dane S. New, 4143 Devon Cir., Cypress, Calif. 90630; Albert W. Dove, 367 Newport Glen Ct., Newport Beach, Calif. 92660

[21] Appl. No.: 871,480

[22] Filed: Jun. 6, 1986

[51] Int. Cl.[4] ..... B63B 35/00

[52] U.S. Cl. ..... 114/66; 441/135

[58] Field of Search ..... 441/65, 74, 129, 135; 114/56, 66, 315; 350/319

[56] References Cited

U.S. PATENT DOCUMENTS

| | | | |
|---|---|---|---|
| 1,786,091 | 12/1930 | Stiles | 114/56 |
| 3,042,945 | 7/1962 | Saeman | 441/135 |
| 3,324,819 | 6/1967 | Tetyak | 441/135 |
| 3,661,109 | 5/1972 | Weiland | 114/291 |

FOREIGN PATENT DOCUMENTS

| | | | |
|---|---|---|---|
| 948041 | 5/1974 | Canada | 114/315 |
| 987832 | 8/1951 | France | 441/135 |
| 1029133 | 5/1953 | France | 441/135 |
| 1254432 | 1/1961 | France | 114/66 |

*Primary Examiner*—Jeffrey V. Nase
*Assistant Examiner*—Jesûs D. Sotelo
*Attorney, Agent, or Firm*—Walter A. Hackler

[57] ABSTRACT

An aquatic sport device includes a buoyant board configured for supporting a user in a prone position thereon and sized to enable the user supported thereby to manually paddle while in a prone position in order to move the buoyant board through the water. A sight opening is provided through the buoyant board in an optical system disposed therein enables a visual perception through the buoyant board by the user when the user is in a prone position. The optical system is configured for enabling the user to look through the board and perceive in a forward direction towards the bow of the buoyant board while paddling.

4 Claims, 7 Drawing Figures

10
12
14
16
20
22
26
34
36
40
44
46
50
52
56
58
62
64
68
80
86
104
108
110
112
116
5
6

AQUATIC SPORT DEVICE

The present invention relates generally to aquatic sport devices and, more particularly, is directed to a paddle board which provides for the user thereof to enjoy underwater viewing.

Views of underwater marine life and structures, such as reefs, have long been appreciated by snorkeling enthusiasts.

So beautiful are these underwater scenes that many tourist attractions include glass bottom boats so that large number of tourists may enjoy the color and marine activity without being inconvenienced or having to invest in snorkel equipment and/or training.

While snorkeling is a sport appreciated by many, it does require a considerable amount of physical stamina because of the swimming activity necessary. Hence, long periods of underwater viewing may be cut short by the physical limitations of the snorkeler. This is particularly true for people who are inexperienced in snorkeling, but would like to participate in the appreciation of local underwater vistas.

Another water sport of popularity, particularly in resort areas, is that of paddle boarding.

Since the paddle board is buoyant, and sized to support a person thereon, the user is able to stay in the water for extended periods of time, without having to exert as much energy as a swimmer. In many instances, the paddle board may be used by a snorkeler as a "base" during his snorkeling activity.

Unfortunately, underwater viewing of marine activity from a paddle board is difficult, or at least uncomfortable, since the user must hang over the edge of the board in order to submerge his mask to facilitate viewing.

A further disadvantage in combined snorkel paddle board activity is the amount of equipment necessary. Individually handled, this equipment may be cumbersome and distracting to the enjoyment of the sport. Hence, there is need for an aquatic sport device which combines snorkeling with paddle boarding and retains the advantages of both.

The present invention addresses that need. A paddle board in accordance with the present invention enables a user thereof to maintain a prone position thereon while viewing underwater vistas without having to hang over the board in an unstable position.

Because the user can remain on the board, he can maintain his observation for much greater periods of time than if he had to maintain his own flotation. An additional advantage of the present invention is the storage facilities afforded by the paddle board for the storage of associated gear, such as wet suits, thereby enabling the paddle board itself to serve as a convenient way to transport such gear to and from areas where the board is to be used.

SUMMARY OF THE INVENTION

An aquatic sport device in accordance with the present invention includes a buoyant board, having a bow and a stern, which is configured for supporting a user in a prone position thereon when the board is disposed on a body of water of sufficient size, depth, to float the buoyant board with the user thereon.

The buoyant board is sized to enable the user supported thereby to manually paddle while in a prone position in order to move the buoyant board through the water.

Additionally, means defining a sight opening through the buoyant board from a first side thereof to a second side thereof is provided.

An optical system disposed in the opening provides means for enabling visual perception through the buoyant board by the user when the user is in a prone position on the buoyant board first side.

Importantly, the optical system is configured for providing a viewing area from the buoyant board second side which is larger than the size of the opening in the buoyant board first side. This enables a greater field of view for the user of the device.

More particularly, the buoyant board, or paddle board, may include a sealable storage compartment therein which is sized for the storage of a wet suit, or the like and a deck portion may be provided between the sight compartment and the paddle board stern, which is sized to accommodate the user in a prone position thereon.

The optical system may include a first and a second transparent member with the first transparent member being supported by topside portions of the buoyant board at an acute angle with the second transparent member which is disposed in the buoyant board opening approximately and generally parallel to the hull of the buoyant board. The first and second transparent member may define a sight compartment therebetween which is disposed aft of the storage compartment.

The angular relationship between the first and second transparent members enables the person looking therethrough to perceive in a forward direction towards the bow of the buoyant board. In addition, the first transparent member is held at an elevated position above the paddle board deck portion and in an angular relationship therewith to enable a person in a prone position on the paddle board deck portion to look forwardly into the sight compartment towards the bow's paddle board.

Specifically, the first and second transparent numbers are aligned with portions of the second transparent number being forward of the forwardmost portions of the first transparent member to enable the person to have a field of view through the buoyant board forward of a vertical line drawn perpendicular to the buoyant board from the forwardmost portion of the first transparent member.

In order to prevent waves or splashing water to interfere with the viewing by a user, a shroud may be provided which is removably attached to the buoyant board topside portions proximate the first transparent member and extending outwardly therefrom. The shroud is adapted for engaging the user's head and operative for substantially eliminating the entry of light and water between the user's head and the buoyant board first transparent number when the user is in an operative relationship with the shroud for looking through the buoyant board.

For water that may strike the first transparent member when the user's head is not engaged with the shroud, means are provided for draining water from the first transparent member surface.

To ensure that the user's view is unobstructed as possible, the hull of the buoyant board may have a V-shaped hull portion on the second side thereof which is disposed between the sight opening and the bow for preventing bubbles, foam and debris from passing over the sight opening, as the buoyant board is floated and moved in a forward direction. Alternatively, a fairing may be provided for guiding bubbles, foam and debris away from the viewing area when the buoyant board is floated and moved in a forward direction.

The fairing may include a pair of vanes disposed in a V-like relationship with an intersection of the vanes being disposed proximate the bow of the buoyant board and the viewing area disposed between the vanes.

BRIEF DESCRIPTION OF THE DRAWINGS

The advantages and features of the present invention will appear from the following description when considered in conjunction with the accompanying drawings, in which.

DETAILED DESCRIPTION

Figures 1, 2, 3, 7:
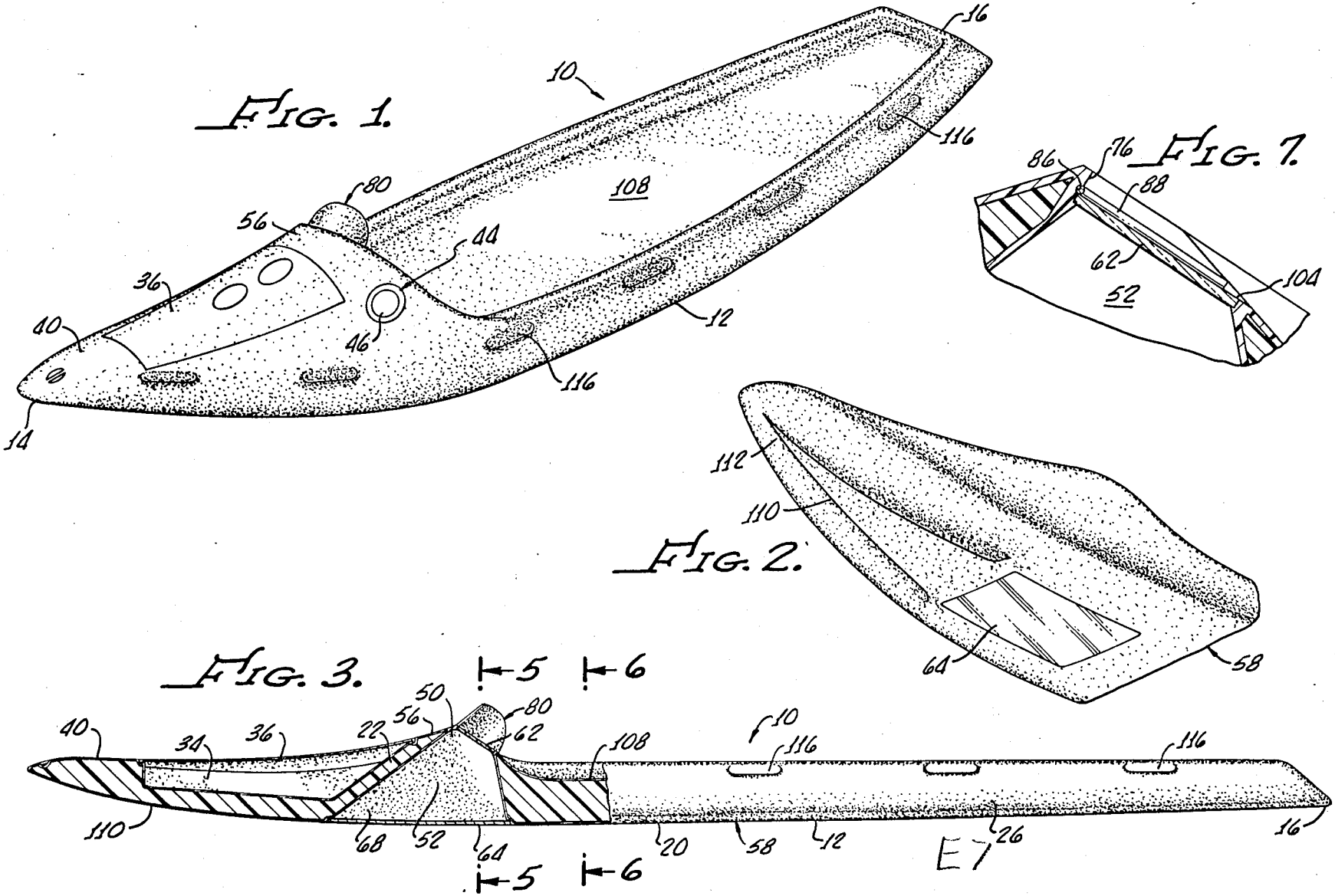
FIG. 1 is a perspective view of an aquatic sport device in accordance with the present invention generally showing a buoyant board having a deck for supporting a user in a prone position for viewing through the board.
FIG. 2 is a perspective view of a forward underside portion of the aquatic sports device generally showing a hull transparent member and a V-shaped fairing to prevent bubbles, foam and debris from passing over the hull transparent member.
FIG. 3 is a cross-section of the sport device generally showing a storage compartment and a sight compartment subtended by a first and the hull, or second, transparent members.
FIG. 7 is an enlarged cross-sectional view of topside portions of the sport device proximate the first transparent member shown as an alternate embodiment for connecting the shroud.

Turning now to FIGS. 1 and 2, there is shown an aquatic sport device 10 in accordance with the present invention generally including a buoyant board, or paddle board, 12, having a bow 14 and a stern 16.

The paddle board 12 may be formed from any suitable structural material, such as plastic or epoxy reinforced with fiberglass, forming a skin 20 and structural portions, or webs, 22, see FIG. 3. The board 12 may be filled with foam 26 to ensure buoyancy and impart structural integrity to the paddle board 12.

The paddle board 12 may take any number of shapes or configurations, but it is important that the paddle board 12 be sized to enable a user (not shown) supported thereby to manually paddle while in a prone position on the board in order to move the buoyant board through the water. These size considerations are related to the width and length of the board and are well known in the art.

Formed into the board is a sealable storage compartment 34 with a lid 36 fitted to topside portions 40 of the paddle board 12 in order to prevent water from entering the compartment, as is well known in the art.

The compartment 34 is sized to accommodate paddle board accessories, such as a wet suit. This provides the aquatic sports device 10 with the advantage that all of the user's equipment may be carried within the paddle board 12 itself, thus facilitating movement of the board to and from marine areas.

Optionally, water-tight compartments, or pockets, 44, may be provided for the storage of small articles, such as watches, coin purses, and the like, to provide ready access to these items, or to provide water-tight protection therefor if the compartment 34 is not provided with the water-tight lid 36.

The pockets 44 may be molded into topside portions 40 of the board 12 and provided with a screw-in cap 46, as is well known in the art.

The topside portion 40 defining a top 50 of a sight opening, or compartment, 52, extending through the board 12 from a first side, or top, 56 of the board to a second side, or hull, 58, of the buoyant board 12.

Figure 4:
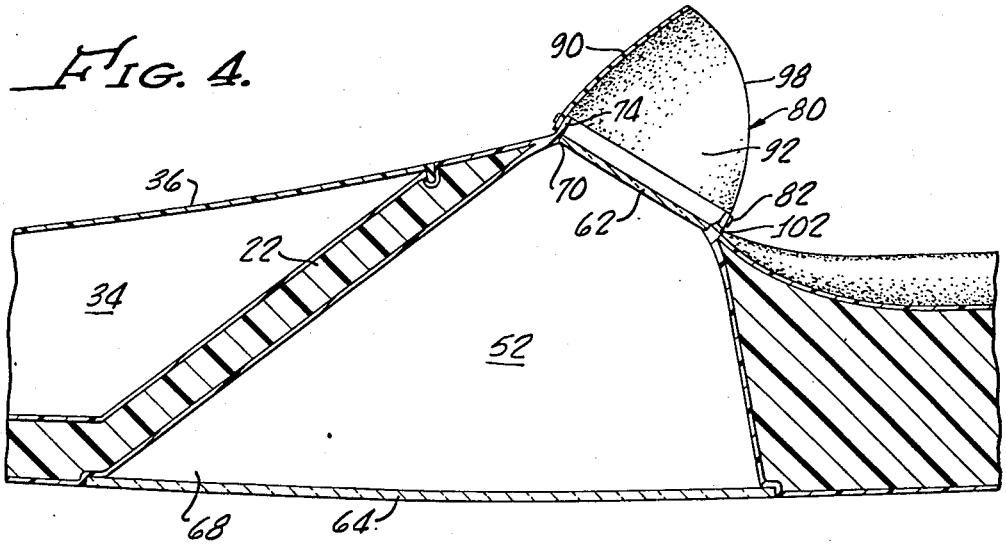
FIG. 4 is an enlarged cross-sectional view of the sight compartment and topside portions of the sport device showing details of the connection of a shroud for preventing water from coming between a user's head and the first transparent member when the board is in use for viewing underground marine landscape and marine activity.
Figure 5:
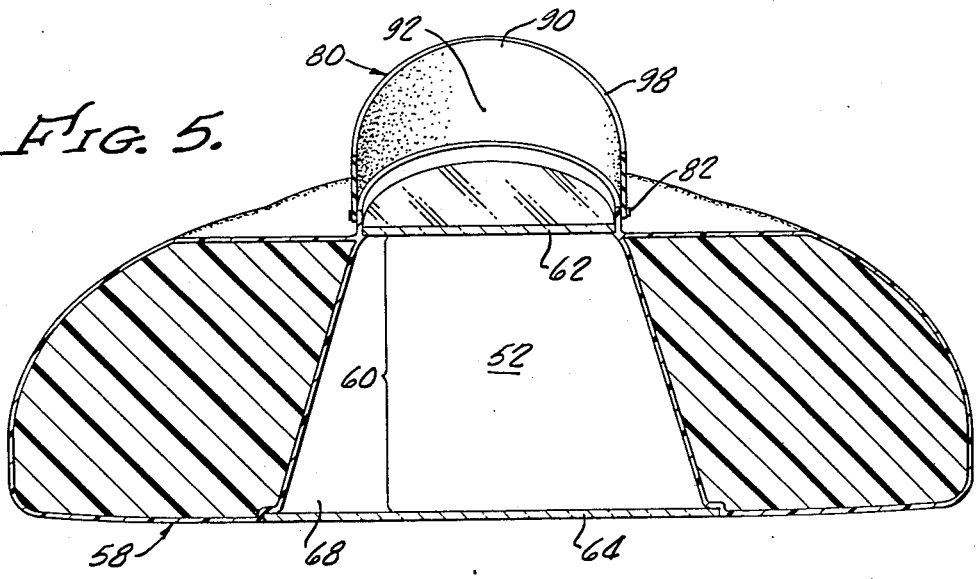
FIG. 5 is a cross-sectional view of the sport device taken along line 5—5 of FIG. 3.

As shown in FIGS. 4 and 5, an optical system 60, includes a first transparent member 62 supported by the topside portion 56 and a second, or hull, transparent member 64, flush-mounted with the hull, 58, at a bottom 68 of the sight compartment 52. Best shown in FIG. 3, the optical system provides a viewing area from the buoyant board 12 second side, or hull, 58, which is larger than the size of the opening 70 in the topside portion of 56 of the board 12.

Figure 6:
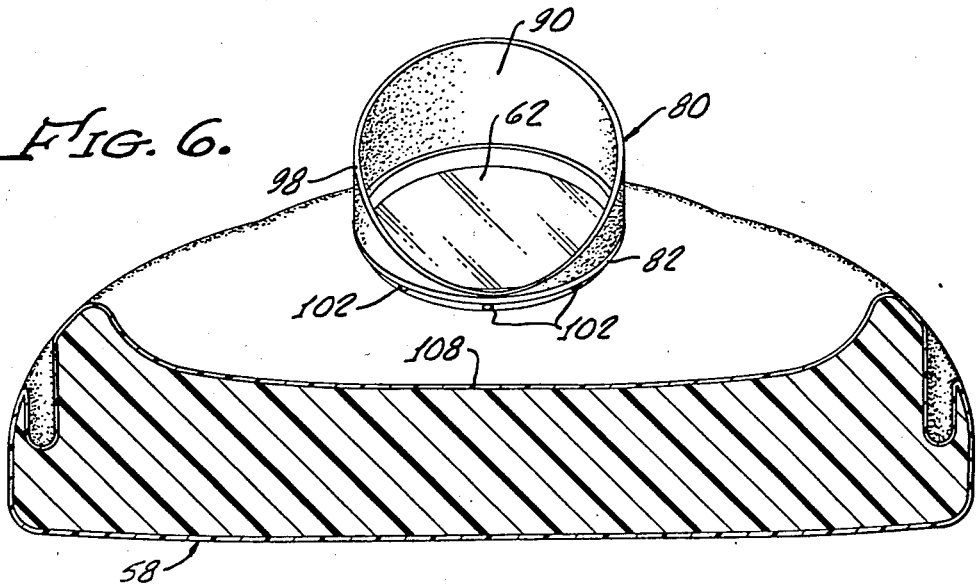
FIG. 6 is a cross-sectional view of the sport device taken along line 6—6 of FIG. 3.

Turning to FIGS. 4, 6 and 7, the topside portion, 56, may include a neck, 74, or a recess, 76 (see FIG. 7 for an alternative embodiment of the present invention) into which the first transparent member is fixed by conventional methods, such as gluing, or the like. A boot, or shroud, 80 formed from a suitable flexible material, such as plastic, sythetic rubber, or the like, may be removably attached by means of a band 82 extending around the shroud and onto the neck 74, as shown in FIGS. 4, 5 and 6, or alternatively as shown in FIG. 7, secured to an inside wall 86 by means of an inside spring 88.

The shroud 80 may have waterproof front 90 and sides, 92 and an open back, with a circumferential lip 98 for engaging a user's head and thereby operative for substantially eliminating the entry of light and water between the user's head and the buoyant board first transparent member 62. In this manner, the user is not distracted by overhead daylight, or water, which may splash over the topside 56 of the board and strike the first transparent member 62, causing a blurry vision through the sight compartment 52. However, water which may strike the first transparent member 62 when the user's head is not engaging the shroud is drained from the first transparent 62 by drainholes 102 (see FIG. 6), alternatively, a runoff area 104 (FIG. 7).

The user is supported by the buoyant board on a deck 108 portion which is disposed aft the sight compartment 52 and the storage compartment 34. It is important that the topside portions 56 support the first transparent member in a relationship with the user and the second transparent member in order to enable the user, in a prone position, on the paddle board deck 108, to look through the sight compartment 52 and the paddle board in a downwardly and forwardly direction.

Since the first transparent member is supported in an elevated position above the paddle board deck 108 and in an angular relationship therewith, the forwardly and downwardly viewing is enabled.

The paddle board will typically be moved in a forward direction by hand or foot paddling. Consequently, observation in a forward direction is important in order to guide the paddle board to areas of most interesting viewing by the user. Hence, the user need not remove his head from the shroud 80 in order to see where he is going, but can keep his eyes on the underwater train and guide himself to areas of most interest to him.

In order to provide a clear view into the water without the disturbance of bubbles, foam, or debris, which may be floating on the water, the hull 58 may be provided with a V-shape near the bow, or alternatively vanes 110 may be attached to, or formed into the hull, to guide the surface bubbles, foam and debris from the second transparent member 64. (See FIG. 2). The vanes 110 may be formed in a V-like relationship with an intersection 112 of the vanes 110 being disposed proximate the bow 40 of the buoyant board, and the second transparent member, or viewing area, 64 disposed between the vanes after the bow.

Since the hull displaces water, surface bubbles, foam and debris are then forced along the vanes 110 and outwardly driven away from the second transparent member 64, as the paddle board is moved through the water.

The first and the second transparent members may be made from any suitable material, such as lucite, or the like, which affords clear viewing therethrough and has an index of refraction which can couple the second transparent member 64 with the water in order to enable distortion less a view therethrough and into the water.

To facilitate handling of the aquatic sports device 10 both in and out of the water, molded hand grips 116 may be provided. (See FIGS. 1 and 3). These grips are, of course, useful when carrying the aquatic device 10 along with the equipment stored in the storage compartment to and from a viewing area, and also for maneuvering and handling the aquatic sports device 10 while it is floating in the water, as well as facilitate the embarking and disembarking of a user onto the board while it is in the water.

Although there has been hereinabove described a specific aquatic sports device in accordance with the present invention for the purpose of illustrating the manner in which the invention may be used to advantage, it should be appreciated that the invention is not limited thereto. Accordingly, any and all modifications, variations, or equivalent arrangements, which may occur to those skilled in the art, should be considered to be within the scope of the invention as defined in the appended claims.

What is claimed is:

1. An aquatic sport device comprising:

a buoyant board, having a bow and a stern, configured for supporting a user in a prone position thereon when disposed on a body of water of sufficient size and depth to float said buoyant board with said user thereon, said buoyant board being sized to enable the user supported thereby to manually paddle while in a prone position in order to move the buoyant board through the water;

means defining a sight opening through said buoyant board from a first side thereof to a second side thereof;

optical system means disposed in said opening for enabling visual perception through said buoyant board by said user when said user is in a prone position on the buoyant board first side, said optical system means being configured for providing a viewing area from the buoyant board second side which is larger than the size of the opening in the buoyant board first side, said optical system comprising a first and a second transparent member and said buoyant board comprising means defining topside portions of said buoyant board for supporting said first transparent member in the buoyant board sight opening at an acute angle with said second transparent member, said second transparent member being disposed in the buoyant board opening proximate and generally parallel to a hull of the buoyant board second side, the angular relationship between the first and second transparent member enabling the user looking therethrough to perceive in a forward direction toward the bow of the buoyant board, said first and second transparent members being aligned with portions of the second transparent member disposed forward of the forwardmost portions of the first transparent member to enable the user to have a field of view through the buoyant board forward of a vertical line drawn perpendicular to the buoyant board from the forwardmost portion of the first transparent member;

means disposed in said topside portion for draining water from the first transparent member surface;

shroud means removably attached to the buoyant board topside portions proximate the first transparent member and extending outwardly therefrom, said shroud means being adapted for engaging the user's head and operative for substantially eliminating the entry of light and water between the user's head and the buoyant board first transparent member when the user's head is in an operative relationship with the shroud for looking through the buoyant board; and fairing means disposed on a hull of the buoyant board for guiding bubbles, foam and debris away from the viewing area when the buoyant board is floating in water and moved in a forward direction, said fairing means comprising a pair of vanes disposed in a V-like relationship with an intersection of the vanes being disposed proximate the bow of the buoyant board, said viewing area being disposed between said vanes.

2. The aquatic sport device according to claim 1 wherein the vanes are formed into the hull.

3. An aquatic sport device comprising:

a lighter than water paddle board having a bow, a stern and a sealable storage compartment therein sized for the storage of a wet suit, a sight compartment disposed aft of said storage compartment, and a deck portion disposed between said sight compartment and the paddle board stern and sized to accommodate a user in a prone position thereon;

means defining a topside portion of said paddle board and forming a top portion of said sight compartment for mounting a first transparent member at an elevated position above the paddle board deck portion and in an angular relationship therewith, said angular relationship enabling a user in a prone position on said paddle board deck portion to look forwardly into the sight compartment towards the bow of the paddle board;

a second transparent member, flush mounted in a hull of the paddle board and forming a bottom portion of said sight compartment, said second transparent member being larger than said first transparent member, said first and second transparent members being aligned with one another to enable a user, in a prone position on the paddle board deck portion, to look through the sight compartment and the paddle board in a downwardly and forwardly direction, fairing means disposed on the buoyant board hull for guiding bubbles, foam and debris away from the second transparent member disposed in the hull when the buoyant board is floating in water and moved in a forward direction, said fairing means comprising a pair of vanes disposed in a V-like relationship with an intersection of the vanes being disposed proximate the bow of the buoyant board and said second transparent member between disposed said vanes.

4. The aquatic sport device according to claim 3 wherein the vanes are formed into the hull portion.

* * * * *